US005879506A

United States Patent [19]

Mueller

[11] Patent Number: 5,879,506

[45] Date of Patent: Mar. 9, 1999

[54] METHOD AND APPARATUS FOR APPLYING LABELS TO CYLINDRICAL PACKAGING CONTAINERS

[75] Inventor: Peter Mueller, Mutlangen, Germany

[73] Assignee: Robert Bosh GmbH, Stuttgart, Germany

[21] Appl. No.: 586,728

[22] PCT Filed: May 5, 1995

[86] PCT No.: PCT/DE95/00589

§ 371 Date: Mar. 20, 1996

§ 102(e) Date: Mar. 20, 1996

[87] PCT Pub. No.: WO95/32124

PCT Pub. Date: Nov. 30, 1995

[30] Foreign Application Priority Data

May 20, 1994 [DE] Germany ..... P 44 17 648.1

[51] Int. Cl.[6] ..... B05C 1/32

[52] U.S. Cl. ..... 156/475; 156/361; 156/493; 156/580; 156/581; 156/540; 156/542; 156/235

[58] Field of Search ..... 156/351, 361, 156/493, 571, 581, 580, 584, 562, 540–542, 475, 235

[56] References Cited

U.S. PATENT DOCUMENTS

| | | | |
|---|---|---|---|
| 3,780,883 | 12/1973 | Brown | 214/2.5 |
| 3,968,743 | 7/1976 | Scherrer | 100/52 |
| 4,132,583 | 1/1979 | Hodgson | 156/357 |
| 4,349,405 | 9/1982 | Dudzik | 156/358 |

*Primary Examiner*—Merrick Dixon

*Attorney, Agent, or Firm*—Edwin E. Greigg; Ronald E. Greigg

[57] ABSTRACT

A label applicator for applying labels to cup-shaped packaging containers including a label storing device means in the form of label rolls, from which labels are removed with the aid of a removal device and labels are applied by a transfer device to the packaging containers. The labels are applied by a contact pressure device to the jacket faces of the packaging containers. Because the application of the labels to packaging containers takes place after the forming of the containers, the design of the label application device is simplified, and accessibility to the containers is improved.

20 Claims, 4 Drawing Sheets

METHOD AND APPARATUS FOR APPLYING LABELS TO CYLINDRICAL PACKAGING CONTAINERS

BACKGROUND OF THE INVENTION

The invention is based on a method and apparatus for applying labels to packaging containers. In a method of this type, known for instance from German Patent Disclosure DE 29 43 076 A1, the labels are placed by a transfer device at a defined point in a forming tool for deep-drawing of cup-shaped packaging containers and are fixed in it by means of a vacuum. Next, a previously heated zone of a sheet of plastic is drawn into the forming tool, so that in the final phase of forming the containers, the labels stick with their adhesive-coated sides to the jacket faces of the packaging containers. A disadvantage of apparatuses operating by this method is that the forming tool is complicated in design, since it has vacuum connections for aspirating the labels against the forming tool, and must also be moved up and down for insertion of the labels. Moreover, the apparatus is relatively poorly accessible, since the transfer device for the labels is located in the immediate vicinity of the forming tool.

ADVANTAGES OF THE INVENTION

The method according to the invention for applying labels to packaging containers has the advantage over the prior art that the application of the labels to the jacket faces of the packaging containers is done outside the forming tool, which improves the accessibility of the label applicator in apparatuses operating by this method.

An apparatus set forth by the invention has the advantage that the design of the forming tool is simplified, since by way of example no divisions or suction conduits for a vacuum connection need to be provided in the forming tool.

By means set forth hereinafter, improvements to and further developments of the apparatus of the invention are possible. The labels can be kept on hand especially efficiently if they are furnished in roll form. Secure attachment of the labels to the packaging containers is attained by using two contact pressure rollers per packaging container.

BRIEF DESCRIPTION OF THE DRAWINGS

An exemplary embodiment of the invention is shown in the drawings and will be described in further detail in the ensuing description.

DETAILED DESCRIPTION OF THE EXEMPLARY EMBODIMENT

Figure 1:
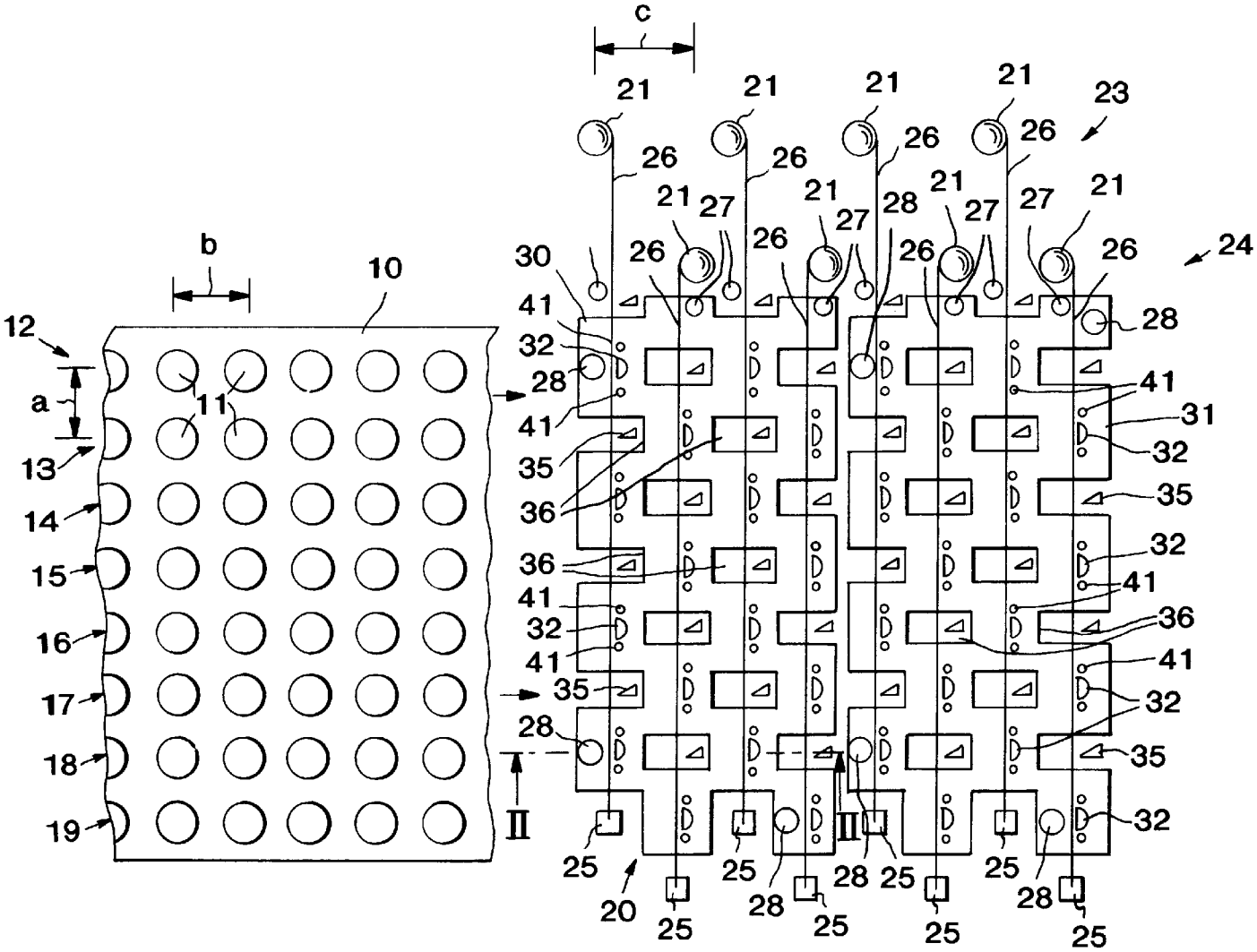
FIG. 1 shows an apparatus for applying labels to packaging containers in simplified, schematic plan view.
Figure 2:
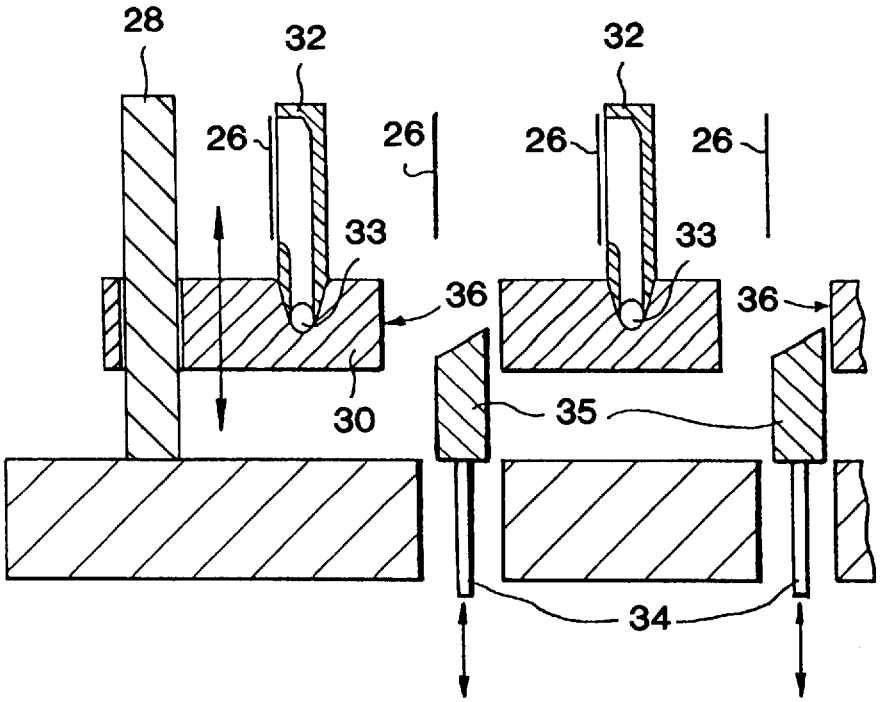
FIG. 2 shows the apparatus of FIG. 1 in a section taken along the line II—II of FIG. 1.
Figure 3:
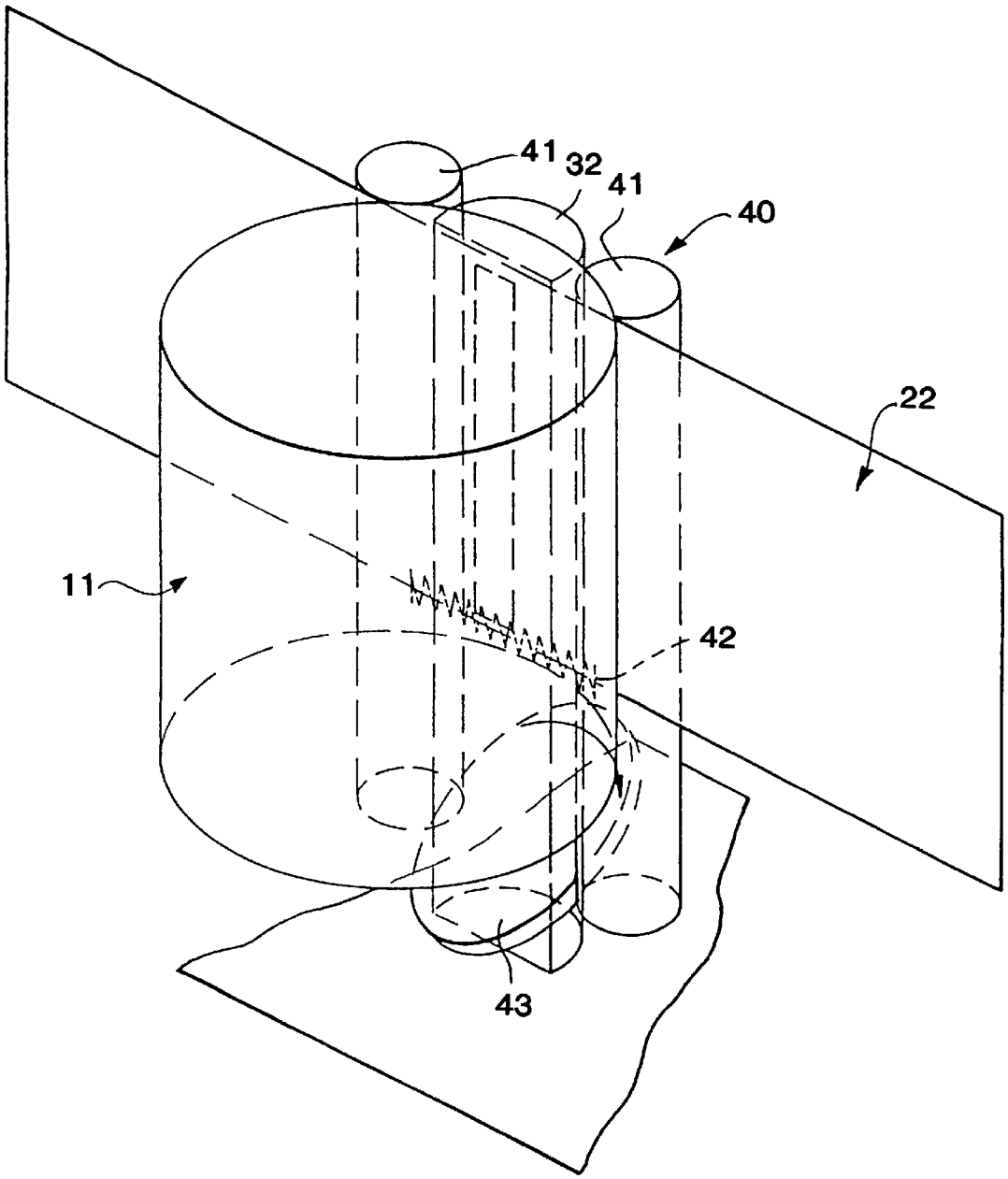
FIG. 3 is a simplified perspective view of a portion of the apparatus of FIG. 1.
Figure 4:
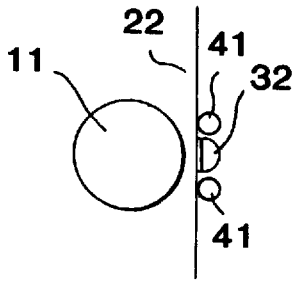
FIGS. 4–7, in simplified plan view, show a portion of the apparatus during successive phases of the application of a label to the packaging container.
Figure 5:
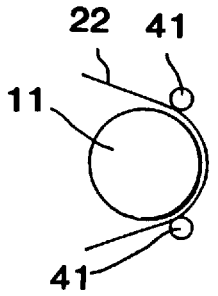
Figure 6:
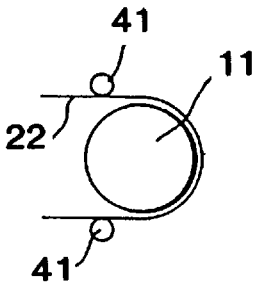
Figure 7:
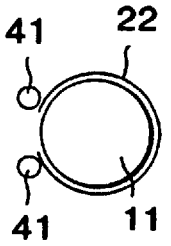

Packaging containers in the form of cups 11 are formed in a sheet 10 of thermoplastic, for instance in eight rows 12–19 disposed parallel in the feeding direction, and spaced apart from one another crosswise and lengthwise by equal distances a, b, respectively. The cups 11 are filled with some food product, such as yogurt, and are tightly sealed by means of a cover film or foil. The sheet 10 is fed intermittently by means of a feed apparatus, likewise not shown, into the range of a label applicator 20.

Below the sheet 10 and the cups 11, the label applicator 20 has a label storing means, in the form of eight vertically arranged label rolls 21. On each label roll 21, labels 22 for the jacket faces of the cups 11 are joined together in one piece and rolls up in the form of a label strip 26. In the exemplary embodiment, the labels are coated with adhesive over the entire surface of one side. The label rolls 21 are disposed in two parallel rows 23, 24, each with four label rolls 21, laterally of the sheet 10, so that the spacing c between the eight label strips 26 paid out in the feeding direction is equivalent to the corresponding spacing b between two cups 11 in the feeding direction. To assure that this spacing c between the individual label strips 26 will always remain the same if the diameter of the label rolls 21 has changed and is now small because labels 22 have been used, each label roll 21 is assigned its own stationary spacer roll 27, over which the label strips 26 are guided.

Each label roll 21 is assigned a pull-off device, in the form of a gripper 25 that by way of example is operated pneumatically. The grippers 25 are movable between two positions in the plane of the label rolls 21, transversely relative to the feeding direction of the sheet 10. In one position, for unrolling labels 22 from the label rolls 21, the grippers 25 are in the immediate vicinity of the spacer rolls 27. In the other position, in which the labels 22 are unrolled in the form of label strips 26 from the label rolls 21, the grippers 25 are shown located laterally beside the sheet 10 and opposite the label rolls 21. The feed path of the sheet 10 is chosen such that the cups 11, viewed in the feeding direction, come to a stop in the region between the feed paths of the grippers 25 or label strips 26.

In the region of the sheet 10, two plates 30, 31 are guided by rods 28 and movable up and down between two terminal positions located below the label rolls 21. In FIG. 1, it appears that the guide rods 28 are in front of the labeling devices; however, the labeling devices are moved above the guide rods during application of the labels. Suction devices 32 associated with the labels 22 or the cups 11 are disposed on the plates 30, 31. The association between the suction devices 32 and the labels 22 or cups 11 is such that one suction device 32 is associated with every second cup 11 of the sheet 10, crosswise to the feeding direction. The suction devices 32 are also offset from one another each by one cup 11 in the feeding direction, from one label strip 26 to the next. In the exemplary embodiment, the width of the labels 22, or the spacing of the rows 12–19 of cups 11, is chosen such that the center of the labels 22 of each label strip 26 is aligned with the center of the associated suction device 32 and of the cup 11.

The suction devices 32 have an elongated shape that for the most part protrudes beyond the height of the labels 22. The suction slits of the suction devices 32 communicate with a controlled negative pressure source, not shown, by means of conduits 33 formed in the plates 30, 31. In the lower terminal position of the plates 30, 31, the suction devices 32 are at the level of label delivery, and in the upper terminal position they are located at the level and in the immediate vicinity of the jacket faces of the cups 11.

One cutting device 34 is associated with each suction device 32 or each label 22 and by way of example includes one knife 35 on each of the two side edges of each label 22. The knives 35 that are movable up and down penetrate the plates 30, 31 in recesses 36.

At the level of the jacket faces of the cups 11, each suction device has a contact pressure device 40 for the labels 22. The contact pressure device 40 is secured to the frame of the label applicator 20 and penetrates the plates 30, 31 in recesses, not shown. The contact pressure device 40 includes, in parallel alignment with the jacket faces of the cups 11, contact pressure rollers 41, which are rotationally movable about its longitudinal axis, on each side of each suction device 32; below the cups 11, these rollers are in frictional engagement with one another by means of a tension spring 42. Below the tension spring 42, the jacket faces of the contact pressure rollers 41 roll along a driven cam disk 43 disposed between them. The shape of the cam disk 43 is adapted to the shape of the jacket face or the diameter of the cups 11. The rotational speed of the cam disk 43 is also adapted to the feeding speed of the sheet 10.

The above-described apparatus for applying labels to packaging containers, such as cups 11, functions as follows:

In a first basic position of the label applicator 20, the two plates 30, 31 are in their lower terminal position, so that the suction devices 32 disposed on them are at the level of the label rolls 21. For pulling the label strips 26 off the label rolls 21, the grippers 25 are moved near the spacer rollers 27, and the ends of the label strips 26 are grasped by means of suitable triggering of the grippers 25. Next, the grippers 25 are moved transversely of the feeding direction of the sheet 10 into their respective terminal position opposite the spacer rollers 27. Once this has occurred, the suction devices 32 are activated via a suitable triggering of the negative pressure source, so that the labels 22 are aspirated by the associated suction devices 32 in their respective center regions and firmly held. During the unrolling of the labels 22 from the label rolls 21, the sheet 10 is simultaneously moved across the label applicator 20, so that the cups 11 come to a stop directly before the respectively associated labels 22, in terms of the feeding direction. With the disposition of cups 10, label strips 26 and suction devices 32 chosen, the first or initial feed path of the sheet 10 is chosen such that the cups 11 (as yet without labels) come to a stop directly before, in terms of the feeding direction, the third from last of the eight label strips 26 that is the fifth labeling row from the rest position of the cups. The plates 30, 31 are now moved into their upper terminal position, so that the suction devices 32 or labels 22 are located at the level of the jacket faces associated with them of the cups 11. Before or during the upward motion of the plates 30, 31, the labels 22 are separated from the label strips 26 by suitable triggering of the knives 35 of the cutting device 34. Next, a slow startup of the sheet 10 in the feeding direction takes place, so that the labels 22 come into adhering contact with the jacket faces of the associated cups 11. Once this has occurred, the negative pressure of the suction devices 32 is turned off, and the plates 30, 31 are returned to their original lower terminal position, and then the above-described pulling of labels 22 from the label rolls 21 is repeated. In the then-ensuing feeding increment of the sheet 10, which together with the aforementioned startup adds up to the spacing b of one row of cups in the sheet 10, the contact pressure rollers 41 of the contact pressure device 40 roll along the jacket faces of the cups 11; the motion of the contact pressure rollers 41 is controlled by the cam disks 43 and the tension springs 42, so that the contact pressure rollers 41 are always in contact with the jacket faces of the cups 11. Once the labels 22 have been entirely applied to the jacket faces of the cups 11, the final exertion of pressure against the labels 22 takes place; that is, the forward motion of the sheet 10 is interrupted for a moment, by way of example, and the contact pressure of the contact pressure rollers 41 on the jacket faces is increased by means of a suitable geometry of the cam disks 43, such as by recesses in the cam disks 43. Once the labels 22 have been entirely pressed on, the contact pressure rollers 41 are returned to their original position in the vicinity of the suction devices 32. A new work cycle then begins, as described above.

Given the chosen disposition of suction devices 32 and plates 30, 31, once two rows of cups in the feeding direction have had labels applied to them, a feeding increment of five rows of cups is executed. With these chosen feed paths, it is assured that labels will be applied to all the jacket faces of the cups 11.

It should be noted that given other dispositions of the suction devices 32 or cups 11 in the sheet 10, other feed paths are also conceivable, or by way of example a separate motion of the two plates 30, 31 is conceivable.

In addition, the labels 22 on the label rolls 21 may also be disposed on a backing paper strip or the like. In that case, a peel-off device should be provided in the region of the spacer rolls 27.

The foregoing relates to preferred exemplary embodiments of the invention, it being understood that other variants and embodiments thereof are possible within the spirit and scope of the invention, the latter being defined by the appended claims.

I claim:

1. An apparatus for applying labels to packaging containers, in which cup-shaped containers (11) are formed in at least one row (12–19) in a plastic sheet (10) and labels (22) are applied to the jacket faces of said cup-shaped containers, at least one label storing means (21) that stores the labels (22) to be applied to each of the cup-shaped containers, and is disposed on a level below the plastic sheet (10) , a device (25) for moving the labels from said storage means to a position of a transfer means (32) for movement of said labels from a label strip to a transfer station for application of said labels onto each of said cup-shaped containers, a contact pressure device located at said transfer station, said transfer means moves independently of said contact pressure means to position one end of the labels in contact with the cup-shaped containers for applying the labels (22) to the jacket faces of the cup-shaped containers (11) by said contact pressure device (40) , and said labels (22) are movable at least crosswise to the feeding direction of the cup-shaped containers (11) during application of the labels to the cup-shaped containers.

2. The apparatus in accordance with claim 1, in which the label removal and transfer devices comprise at least one pull-off device (25) that is movable crosswise to the feeding direction of the plastic sheet (10) in a plane between the jacket faces, said pull-off device removes at least one label (22) from the label storing means (21) and positions the at least one label below and in alignment with at least one of said cup-shaped containers (11), and that suction devices (32) are provided, which are movable vertically up to the level of the jacket faces of the cup-shaped containers (11) and are aligned with the cup shaped containers in the feeding direction of the cup shaped containers (11).

3. The apparatus in accordance with claim 2, in which the suction devices (32) have a shape that for the most part covers a height of the labels (22).

4. The apparatus in accordance with claim 1, in which the contact pressure device (40) comprises two contact pressure rollers (41), which are movable toward and away from one another and which are disposed in alignment with and on opposite sides of the suction devices (32).

5. The apparatus in accordance with claim 2, in which the contact pressure device (40) comprises two contact pressure rollers (41), which are movable toward and away from one another and which are disposed in alignment with and on opposite sides of the suction devices (32).

6. The apparatus in accordance with claim 3, in which the contact pressure device (40) comprises two contact pressure rollers (41), which are movable toward and away from one another and which are disposed in alignment with and on opposite sides of the suction devices (32).

7. The apparatus in accordance with claim 4, in which the contact pressure rollers (41) are raised and lowered between a first terminal position below the cup-shaped containers (11) and a second terminal position at a level of the jacket faces of the cup-shaped containers (11).

8. The apparatus in accordance with claim 5, in which the contact pressure rollers (41) are raised and lowered between a first terminal position below the cup-shaped containers (11) and a second terminal position at a level of the jacket faces of the cup-shaped containers (11).

9. The apparatus in accordance with claim 6, in which the contact pressure rollers (41) are raised and lowered between a first terminal position below the cup-shaped containers (11) and a second terminal position at a level of the jacket faces of the cup-shaped containers (11).

10. The apparatus in accordance with claim 1, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

11. The apparatus in accordance with claim 2, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

12. The apparatus in accordance with claim 3, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

13. The apparatus in accordance with claim 4, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

14. The apparatus in accordance with claim 5, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

15. The apparatus in accordance with claim 6, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

16. The apparatus in accordance with claim 7, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

17. The apparatus in accordance with claim 8, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

18. The apparatus in accordance with claim 9, in which the label storing means is a label roll (21), in which the labels (22) follow one another in one continuous piece, and includes a cutting device (34) for separating the labels (22), said cutting device is associated with each of said cup-shaped containers (11) in a plane of the pull-off device (25).

19. The apparatus in accordance with claim 1, in which the label storing means is a label roll (21) on which the labels (22) are disposed on a backing strip, and a peel-off device for the backing strip is disposed in a plane of the pull-off device (25).

20. A method for applying labels in a label application machine to a jacket face of cup-shaped packaging containers (11) formed in at least one row (12–19) in a plastic sheet (10), the labels (22) are applied after the formation of the cup-shaped packaging containers (11), the method comprises moving the plastic sheet of cup-shaped packaging containers in the label application machine, stopping the plastic sheet with a first container of said at least one row at a label application station, simultaneous with movement of a first of said cup-shaped packaging containers to said label application station, transferring a label from a label dispenser to the label application station, and upon stopping the first of said cup-shaped packaging containers at the label application station, begin applying a label to each of said first of said cup shaped containers of each of said at least one row located at the application station, moving the plastic sheet of said cup-shaped packaging containers during application of said label and stopping said plastic sheet with a next row of said cup-shaped packaging containers in succession in each of said at least one row at the label application station, simultaneous with movement of said plastic sheet for movement by a spacing of one row of said cup-shaped packaging containers to said label application station, transferring a label from the label dispenser to the label application station for each of said cup-shaped packaging containers, and upon stopping movement of said plastic sheet with said cup-shaped packaging containers located at the label application station for each of said cup-shaped packaging containers, and upon stopping movement of said plastic sheet with said cup-shaped packaging containers at the label application station, applying a label to each of the cup-shaped packaging containers located at the label application station and continuing the process of moving the plastic sheet to position said cup-shaped packaging containers at the label application station, simultaneous with movement of the plastic sheet, transferring labels to the label application station, stopping the plastic sheet with the cup shaped packaging containers at the label application station and when stopped, starting to apply a label to each of said cup-shaped packaging containers stopped at the label application station and moving the plastic container as the label is applied thereto, and continuing the process until labels have been applied to each of the cup-shaped packaging containers at each row of said cup-shaped packaging containers.

* * * * *